United States Patent [19]

Matsushita et al.

[11] Patent Number: 4,579,770

[45] Date of Patent: Apr. 1, 1986

[54] MULTICOLOR HEAT TRANSFER PAPER

[75] Inventors: Toshihiko Matsushita, Funabashi; Sadao Morishita, Ibaraki, both of Japan

[73] Assignee: Mitsubishi Paper Mills, Ltd., Tokyo, Japan

[21] Appl. No.: 645,765

[22] Filed: Aug. 30, 1984

[30] Foreign Application Priority Data

Sep. 2, 1983 [JP] Japan ..... 58-161572

[51] Int. Cl.[4] ..... B41M 5/26

[52] U.S. Cl. ..... 428/213; 8/471; 428/207; 428/216; 428/321.5; 428/323; 428/327; 428/913; 428/914

[58] Field of Search ..... 8/471, 472; 346/204, 346/207, 216; 428/207, 211, 321.5, 341, 342, 913, 914, 212, 213, 215, 216, 323, 327

[56] References Cited

U.S. PATENT DOCUMENTS

| | | | |
|---|---|---|---|
| 3,317,433 | 2/1967 | Eichel | 428/321.5 |
| 3,647,504 | 2/1972 | Hayes et al. | 428/321.5 |

*Primary Examiner*—Bruce H. Hess

*Attorney, Agent, or Firm*—Cushman, Darby & Cushman

[57] ABSTRACT

By using a multicolor heat transfer paper comprising a substrate and a mixture of at least two kinds of microcapsules coated on the substrate (each kind of microcapsules contain a different heat-sublimable dye and have a different film thickness), there can be obtained a clear multicolor transferred image only by the temperature control of the thermal head of a printer.

17 Claims, No Drawings

MULTICOLOR HEAT TRANSFER PAPER

This invention relates to a multicolor heat transfer recording paper. More particularly, the invention relates to a multicolor heat transfer recording paper using heat-sublimable dyes.

In recent years, in coping with the heat-sensitive recording method using a thermal recording equipment such as a thermal printer, a thermal facsimile or the like, a heat transfer recording method having advantages such as good storage stability or indelibility after recording, solvent resistance and the like has come to be in practical use. In this new method, a heat transfer recording paper consisting of a substrate and a heat-meltable ink layer formed on the substrate is superimposed on a plain paper so that the ink layer side of the former paper contacts with the latter paper; a heat is applied onto the heat transfer recording paper by the thermal head of a thermal facsimile or the like to transfer the ink of the heat transfer recording paper onto the plain paper; thereby recording is made on the plain paper.

Recording by heat transfer for a single color (e.g. black color) is already in practical use. Research on recording by heat transfer has been shifted from single color to multicolor and results of researches on multicolor heat transfer recording paper are described in various Japanese unexamined or examined patent publications. For example, Japanese unexamined patent publication No. 187296/1982 discloses a multicolor heat transfer paper consisting of a substrate and a transfer layer formed on the main side of the substrate, the transfer layer containing three kinds of microcapsules capable of transferring three primitive colors, red, blue and yellow and having different melting points. According to the publication, each color can be transferred just by controlling the temperature of thermal head whereby a simplified equipment can be used.

Single color heat transfer recording papers already in practical use as well as multicolor heat transfer recording papers described in various Japanese unexamined and examined patent publications use in many cases organic pigments (dyes) or inorganic pigments each having a different color.

Meanwhile, multicolor heat transfer methods using heat-sublimable dyes are described, for example, in Japanese unexamined patent publication No. 43538/1978. In the method of this patent publication, there is used a heat-sublimable ink ribbon consisting of a substrate layer and a transfer layer formed on the substrate layer, the transfer layer containing a plurality of heat-sublimable dyes each having a different sublimation temperature; letters output from a heat-sensitive printer are recorded onto a plain paper through the above mentioned heat-sublimable ink ribbon. In this transfer method, the difference in sublimation temperature among heat-sublimable dyes enables multicolor recording.

However, the above transfer method, because it utilizes the difference in sublimation temperature among heat-sublimable dyes, has the following drawbacks. That is, heat-sublimable dyes generally have high sublimation temperatures, which makes it difficult to select appropriate three dyes of three primitive colors each having a sublimation temperature different from those of each other. Even if such dyes are available, respective sublimation temperatures are broad and there occurs overlapping of sublimation temperatures. Prevention of this overlapping requires that sublimation temperatures of these dyes be greatly different. Further, if sublimation temperatures are greatly different, it is difficult to transfer a heat-sublimable dye having a very high sublimation temperature with a thermal head.

In order to solve these drawbacks, the present inventors made an extensive study. As a result, by coating a substrate material with at least two kinds of microcapsules each containing a different heat-sublimable dye and each having a different film thickness, there could be provided a multicolor heat transfer paper capable of forming a multicolor transferred image only by the temperature control of thermal head.

In the present invention, at least two kinds of heat-sublimable dyes, for example, yellow, magenta and cyan heat-sublimable dyes or yellow, magenta, cyan and black heat-sublimable dyes are contained in respective microcapsules each of different film thickness, and these microcapsules each containing a different color dye and having a different film thickness are independently coated on a substrate material. Consequently, even if the above heat-sublimable dyes have a same sublimation temperature, the difference in film thickness among different microcapsules enables transfer of a multicolor image only by the temperature control of thermal head. When the difference in film thickness among different microcapsules is combined with the difference in sublimation temperature among heat-sublimable dyes, the temperature control of thermal head becomes much easier.

Since heat-sublimable dyes generally have broad sublimation temperature ranges, it is difficult to obtain a clear image by transferring these dyes only by utilization of their sublimation temperatures. In the present invention, since microcapsules containing a particular heat-sublimable dye have a particular film thickness and the dye is transferred at a particular transfer temperature, there can be obtained a clear image.

In the present invention, if it is desired for any reason that a heat-sublimable dye of low sublimation temperature be used at a higher temperature than the sublimation temperature, it becomes possible by making larger the film thickness of microcapsules containing that dye.

In the present invention, by using an aqueous dispersion containing at least two kinds of microcapsules containing yellow, magenta and cyan heat-sublimable dyes or yellow, magenta, cyan and black heat-sublimable dyes, there can be obtained a multicolor heat transfer paper in a large quantity just by one time coating of the dispersion. When the aqueous dispersion is converted to a microcapsule powder by a method such as spray drying or the like, spot printing becomes possible by dispersing the powder in a solvent.

According to the present invention, at least two kinds of heat-sublimable dyes, for example, yellow, magenta and cyan dyes or yellow, magenta, cyan and black dyes are independently encapsulated with a different microcapsule film thickness used for each dye and are then coated at random on a substrate, whereby a multicolor heat transfer paper is produced. If it is assumed that the film thicknesses of respective microcapsules containing yellow, magenta and cyan dyes are in increase in this order and that these dyes have a substantially same sublimation temperature and when it is intended to transfer a multicolor original image through the above produced transfer paper, at first a recording signal for yellow corresponding to the yellow portion of the original image is transmitted to a thermal head to heat and control the head at a temperature matching the film thickness of the yellow-containing microcapsules of the transfer recording paper and enabling the transfer of the yellow dye, whereby the yellow dye can easily be transferred through the microcapsule film onto a paper on which a transferred image is formed. Similarly, magenta and and cyan dyes can independently be transferred by using higher thermal head temperatures matching the film thicknesses of magenta and cyan microcapsules and enabling the transfer of these dyes.

The film thicknesses of microcapsules containing heat-sublimable dyes according to the present invention can be such that, when yellow, magenta and cyan have a same sublimation temperature, a smallest film thickness, namely, a film thickness enabling the transfer of a dye at a lowest temperature is 1 and a largest film thickness, namely, a film thickness enabling the transfer of a dye at a highest temperature is about 5 to 20, preferably 7.5 to 15 and more preferably about 10. This relationship among film thicknesses of different microcapsules can be changed as necessary depending upon the sublimation temperature and molecular structure of each dye. The reason is that these films are not films which can not permeate heat-sublimable dyes but films which are porous and can permeate the dyes, and hence their thicknesses are required to differ by the size of the molecular structure of a dye selected.

Next, the materials constituting the multicolor heat transfer recording paper of the present invention will be explained.

As the heat-sublimable dyes there can be mentioned, for example, when expressed in Color Index Number, Solvent Yellow 77, Solvent Yellow 116, Disperse Yellow 7, Disperse Yellow 54, Solvent Blue 36, Solvent Blue 83, Solvent Blue 105, Disperse Blue 99, Disperse Blue 108, Disperse Red 1, Disperse Red 59, Disperse Red 60, Disperse Violet 28, etc.

As the substrate, a thin substrate is desirable viewed from the requirements of transferring. There can be used a paper such as a condenser paper, a glassine paper or the like, or a resin film of a polyester, a polyimide, a polycarbonate, a teflon or the like, each having a thickness of 10 to 30 $\mu$m.

As the material on which a transferred image is formed, there can be used a paper such as a wood free paper, an art paper, a coated paper or the like. Besides, the above mentioned substrates may be used.

As the method for encapsulation, there can be used a method known in the industry such as a complex coacervation method, an in-situ method, an interfacial polymerization method, a spray drying method or the like. Other method may be used.

A coating color comprising microcapsules containing heat-sublimable dyes according to the present invention can, as necessary, be admixed with a binder, a wax, a pigment, a stilt and the like. The coating color may further be admixed with materials other than these.

As the method for producing a multicolor heat transfer recording paper of the present invention, there can be mentioned a method wherein a dispersion of coating color in water is coated on the whole surface of a substrate by an ordinary coater such as an air knife coater, a method wherein a dispersion of dry microcapsules in an organic solvent is printed on part or the whole part of the surface of a substrate by the use of a flexographic press, a photogravure press or the like, or other appropriate production method.

In the present invention, various kinds of microcapsules each containing a heat-sublimable dye of a particular color are used in combination. Typical combinations of these microcapsules are yellow-containing microcapsules, magenta-containing microcapsules and cyan-containing microcapsules, as well as yellow-containing microcapsules, magenta-containing microcapsules, cyan-containing microcapsules and black-containing microcapsules. As necessary, microcapsules containing heat-sublimable dyes of other colors may be added to these combinations.

In the combination of various microcapsules each containing a different heat-sublimable dye, individual microcapsules can have film thicknesses, for example, as shown below.

| | Order of film thickness of microcapsules | | |
|---|---|---|---|
| | Thickest | Medium | Thinnest |
| Case 1 | Y-containing mcs | M-containing mcs | C-containing mcs |
| Case 2 | Y-containing mcs | C-containing mcs | M-containing mcs |
| Case 3 | M-containing mcs | Y-containing mcs | C-containing mcs |
| Case 4 | M-containing mcs | C-containing mcs | Y-containing mcs |
| Case 5 | C-containing mcs | Y-containing mcs | M-containing mcs |
| Case 6 | C-containing mcs | M-containing mcs | Y-containing mcs |

[Note: In the above table, Y is yellow, M is magenta, C is cyan and mcs is microcaplules.]

When black-containing or other dye-containing microcapsules are added to any of these microcapsules combinations, the film thickness of each component microcapsules can be decided based on the above film thickness order.

Film thicknesses of these microcapsules can optionally be selected in the range of 75 to 2,000 Å, preferably 110 to 1,500 Å. For example, when three kinds of microcapsules containing yellow, magenta and cyan are used in combination, these microcapsules can have film thicknesses of 75 to 300 Å, 250 to 1,000 Å and 500 to 2,000 Å, preferably 110 to 225 Å, 375 to 750 Å and 750 to 1,500 Å, respectively. As an example, yellow-containing microcapsules can have a film thickness of 75 to 300 Å, magenta-containing microcapsules a film thickness of 250 to 1,000 Å and cyan-containing microcapsules a film thickness of 500 to 2,000 Å; more preferably, yellow-containing microcapsules can have a film thickness of 110 to 225 Å, magenta-containing microcapsules a film thickness of 375 to 750 Å and cyan-containing microcapsules a film thickness of 750 to 1,500 Å.

The mixing ratio of different microcapsules can optionally be controlled. As an example, the microcapsules of smallest addition amount is used in an amount of 1 part by weight while the microcapsules of largest addition amount is used in an amount of about 3 to 5 parts by weight, preferably about 1.5 to 3 parts by weight. When three kinds of microcapsules containing yellow, magenta and cyan are used in combination, the mixing ratio of these microcapsules can be controlled freely but is, for example, 1 (e.g. yellow-containing microcapsules): 0.6 to 2.4 (e.g. magenta-containing microcapsules): 0.75 to 3 (e.g. cyan-containing microcapsules), preferably 1 (e.g. yellow-containing microcapsules): 0.9 to 1.8 (e.g. magenta-containing microcapsules): 1.1 to 2.3 (e.g. cyan-containing microcapsules).

The present invention will specifically be explained below by way of Example. Parts in the Example refer to parts by weight.

EXAMPLE

1. Three kinds of microcapsules each containing heat-sublimable yellow, magenta and cyan dyes were produced as follows.

(a) Microcapsules containing a heat-sublimable yellow dye

A styrene-maleic anhydride copolymer heated at 60° C. and a small amount of sodium hydroxide were dissolved in water, whereby there was prepared an aqueous solution of pH 4.0 containing 5% of a styrene-maleic anhydride copolymer and a small amount of sodium hydroxide. In 100 parts of this solution was dispersed 50 parts of Color Index Number "Disperse Yellow 54" (brand name: Kayaset Yellow A.G, manufactured by NIPPON KAYAKU) and an emulsion was prepared. 3 Parts of melamine, 7.5 parts of a 37% aqueous formaldehyde solution, 40 parts of water and a slight amount of sodium hydroxide were mixed. The mixture was heated to 60° C. In 15 min, the mixture became transparent and a melamine-formalin precondensate was obtained. This precondensate was added to the above prepared emulsion. The mixture was stirred at 60° C. (liquid temperature) for 3 hr, whereby encapsulation was completed.

(b) Microcapsules containing a heat-sublimable magenta dye

A styrene-maleic anhydride copolymer heated at 60° C. and a small amount of sodium hydroxide were dissolved in water, whereby there was prepared an aqueous solution of pH 4.0 containing 5% of a styrene-maleic anhydride copolymer and a small amount of sodium hydroxide. In 100 parts of this solution was dispersed 50 parts of Color Index Number "Disperse Red 60" (Kayaset Red B manufactured by NIPPON KAYAKU) and an emulsion was prepared. 10 Parts of melamine, 25 parts of a 37% aqueous formaldehyde solution, 60 parts of water and a small amount of sodium hydroxide were mixed. The mixture was heated to 60° C. In 15 min, the mixture became transparent and a melamine-formalin precondensate was obtained. This precondensate was added to the above prepared emulsion. The mixture was stirred at 60° C. (liquid temperature) for 3 hr, whereby encapsulation was completed.

(c) Microcapsules containing a heat-sublimable cyan dye

A styrene-maleic anhydride copolymer heated at 60° C. and a small amount of sodium hydroxide were dissolved in water, whereby there was prepared an aqueous solution of pH 4.0 containing 5% of a styrene-maleic anhydride copolymer and a small amount of sodium hydroxide. In 100 parts of this solution was dispersed 50 parts of Color Index Number "Solvent Blue 105" (Kayaset Blue FR manufactured by NIPPON KAYAKU) and an emulsion was prepared. 20 Parts of melamine, 50 parts of a 37% aqueous formaldehyde solution, 90 parts of water and a small amount of sodium hydroxide were mixed. The mixture was heated to 60° C. In 15 min, the mixture became transparent and a melamine-formalin precondensate was obtained. This precondensate was added to the above prepared emulsion. The mixture was stirred at 60° C. (liquid temperature) for 3 hr, whereby encapsulation was completed.

The film thicknesses of the three kinds of microcapsules prepared in the above (a), (b) and (c) were set at about 150 Å, 500 Å and 1,000 Å, respectively.

2. A multicolor heat transfer recording paper was produced as follows.

The three kinds of microcapsules containing heat-sublimable yellow, magenta and cyan dyes obtained in the above 1 were mixed according to the following ratio, and the mixture was coated on a glassine paper of 26 g/m$^2$ by the use of a Meyer bar so that the coated amount as dried became about 6 g/m$^2$.

| | |
|---|---|
| Yellow-containing microcapsules | 30 Parts |
| Magenta-containing microcapsules | 36 " |
| Cyan-containing microcapsules | 45 " |
| Microcrystalline wax emulsion | 15 " |
| Paraffin wax emulsion | 15 " |

The above parts are parts as solid. This mixture was used as an aqueous dispersion containing 30% of a total solid.

The coated side of the thus produced multicolor heat transfer recording paper was superimposed on a plain paper. Then, the heat transfer recording paper was subjected to printing by using a facsimile tester manufactured by Matsushita Electronic Components and by applying, to the thermal head of the facsimile tester, electronic energies each matching the sublimation temperature of yellow, magenta or cyan dye and the film thickness of microcapsules containing one of these dyes, whereby a clear multicolor heat-transferred image comprising single colors and compound colors was formed on the plain paper.

We claim:

1. A multicolor heat transfer recording paper comprising a substrate and a mixture of at least two kinds of microcapsules coated on the substrate, each kind of microcapsules containing a different heat-sublimable dye and having a different film thickness, said heat sublimable dye being capable of permeating through the porous membrane film of the microcapsule in a manner which is dependent upon both the heating temperature and the membrane film thickness when the heat-sublimable dye has been heated-sublimated by heating.

2. A multicolor heat transfer paper recording according to claim 1, wherein the heat-sublimable dyes each contained in a particular kind of microcapsules are yellow, magenta, cyan and black.

3. A multicolor heat transfer recording paper according to claim 1, wherein the heat-sublimable dyes each contained in a particular kind of microcapsules are yellow, magenta and cyan.

4. A multicolor heat transfer recording paper according to claim 3, wherein the yellow containing microcapsules have the largest film thickness, the magenta-containing microcapsules the medium film thickness and the cyan-containing microcapsules a smallest film thickness.

5. A multicolor heat transfer recording paper according to claim 3, wherein the yellow-containing microcapsules have the largest film thickness, the cyan-containing microcapsules a medium film thickness and the magneta-containing microcapsules the smallest film thickness.

6. A multicolor heat transfer recording paper according to claim 3, wherein the magenta-containing microcapsules have the largest film thickness, the yellow-containing microcapsules a medium film thickness and the cyan-containing microcapsules the smallest film thickness.

7. A multicolor heat transfer recording paper according to claim 3, wherein the magenta-containing microcapsules have the largest film thickness, the cyan-containing microcapsules a medium film thickness and the yellow-containing microcapsules the smallest film thickness.

8. A multicolor heat transfer recording paper according to claim 3, wherein the cyan-containing microcapsules have the largest film thickness, the yellow-containing microcapsules a medium film thickness and the magenta-containing microcapsules the smallest film thickness.

9. A multicolor heat transfer recording paper according to claim 3, wherein the cyan-containing microcapsules have the largest film thickness, the magenta-containing microcapsules a medium film thickness and the yellow-containing microcapsules the smallest film thickness.

10. A multicolor heat transfer recording paper according to claim 1, wherein the ratio of the largest film thickness of microcapsules to the smallest film thickness is 20—5 to 1.

11. A multicolor heat transfer recording paper according to claim 10, wherein the ratio of the largest film thickness of microcapsules to the smallest film thickness is 15—75 to 1.

12. A multicolor heat transfer recording paper according to claim 3, wherein the microcapsules having the smallest film thickness have a film thickness of 75 to 300 Å, the microcapsules having a medium film thickness have a film thickness of 250 to 1,000 Å and the microcapsules having the largest film thickness have a film thickness of 500 to 2,000 Å.

13. A multicolor heat transfer recording paper according to claim 12, wherein the yellow-containing microcapsules have a film thickness of 75 to 300 Å, the magenta-containing microcapsules have a film thickness of 250 to 1,000 Å and the cyan-containing microcapsules have a film thickness of 500 to 2,000 Å.

14. A multicolor heat transfer recording paper according to claim 13, wherein the yellow-containing microcapsules have a film thickness of 110 to 225 Å, the magenta-containing microcapsules have a film thickness of 375 to 750 Å and the cyan-containing microcapsules have a film thickness of 750 to 1,500 Å.

15. A multicolor heat transfer recording paper according to claim 3, wherein the mixing ratio of three kinds of microcapsules is 1:0.6 to 2.4:0.75 to 3 on weight basis.

16. A multicolor heat transfer recording paper according to claim 15, wherein the mixing ratio of yellow-containing microcapsules, magenta-containing microcapsules and cyan-containing microcapsules is 1:0.6 to 2.4:0.75 to 3 on weight basis.

17. A multicolor heat transfer recording paper according to claim 16, wherein the mixing ratio of yellow-containing microcapsules, magenta-containing microcapsules and cyan-containing microcapsules is 1:0.9 to 1.8:1.1 to 2.3.

* * * * *